US011261587B2

(12) United States Patent
Rosandich et al.

(10) Patent No.: US 11,261,587 B2
(45) Date of Patent: Mar. 1, 2022

(54) INTEGRATED MIXED TAP WATER AND CONDITIONED WATER FAUCET ASSEMBLY WITH PULL OUT SPRAYER HEAD

(71) Applicant: EMERSON ELECTRIC CO., St. Louis, MO (US)

(72) Inventors: Joseph D. Rosandich, Greenfield, WI (US); Thomas E. Lefeber, Mount Pleasant, WI (US); Peter J. Loire, Genoa City, WI (US); Matthew A. Schmitt, Kenosha, WI (US)

(73) Assignee: Emerson Electric Co., St. Louis, MO (US)

( * ) Notice: Subject to any disclaimer, the term of this patent is extended or adjusted under 35 U.S.C. 154(b) by 145 days.

(21) Appl. No.: 16/611,954

(22) PCT Filed: Jun. 29, 2018

(86) PCT No.: PCT/US2018/040274
§ 371 (c)(1),
(2) Date: Nov. 8, 2019

(87) PCT Pub. No.: WO2019/010078
PCT Pub. Date: Jan. 10, 2019

(65) Prior Publication Data

US 2021/0079634 A1 Mar. 18, 2021

Related U.S. Application Data

(60) Provisional application No. 62/529,509, filed on Jul. 7, 2017.

(51) Int. Cl.
*E03C 1/04* (2006.01)
*E03C 1/044* (2006.01)

(52) U.S. Cl.
CPC ..... *E03C 1/0405* (2013.01); *E03C 1/044* (2013.01); *E03C 2001/0415* (2013.01)

(58) Field of Classification Search
CPC ..... E03C 1/0405; E03C 1/044; E03C 2001/0415; E03C 1/0404
See application file for complete search history.

(56) References Cited

U.S. PATENT DOCUMENTS

| | | | | |
|---|---|---|---|---|
| 4,077,545 | A | 3/1978 | Karls | |
| 9,545,639 | B2 * | 1/2017 | Meehan | B05B 1/1627 |
| 2006/0202142 | A1 * | 9/2006 | Marty | E03C 1/055 251/129.04 |

FOREIGN PATENT DOCUMENTS

| | | | |
|---|---|---|---|
| CN | 102537410 | A | 7/2012 |
| CN | 204201162 | U | 3/2015 |

(Continued)

OTHER PUBLICATIONS

International Search Report and Written Opinion regarding PCT/US2018/040274, dated Oct. 8, 2018.

*Primary Examiner* — Qingzhang Zhou
(74) *Attorney, Agent, or Firm* — Harness, Dickey & Pierce, P.L.C.

(57) ABSTRACT

An integrated mixed tap water and conditioned water faucet assembly has a pull-out sprayer head and a spout. The spout has an upwardly extending portion, a downwardly extending dispensing portion and a bight extending between the upwardly extending portion and the downwardly extending dispensing portion. A conditioned water housing and the sprayer head are disposed at a lower end of the downwardly extending dispensing portion and extend downwardly therefrom.

17 Claims, 9 Drawing Sheets

(56) References Cited

FOREIGN PATENT DOCUMENTS

| | | | |
|---|---|---|---|
| CN | 205745560 | U | 11/2016 |
| CN | 205841850 | U | 12/2016 |
| CN | 205877394 | U | 1/2017 |
| CN | 206112199 | U | 4/2017 |
| DE | 202013101343 | U1 | 5/2013 |
| EP | 2384819 | A1 | 11/2011 |
| EP | 2975185 | A1 | 1/2016 |
| GB | 2523569 | A | 9/2015 |
| JP | H1061797 | A | 3/1998 |
| JP | H115045 | A | 1/1999 |
| JP | 2004205074 | A | 7/2004 |
| JP | 2006144329 | A | 6/2006 |
| JP | 2011137604 | A | 7/2011 |
| WO | WO-2016172037 | A2 | 10/2016 |
| WO | WO-2017/123087 | A1 | 7/2017 |

* cited by examiner

INTEGRATED MIXED TAP WATER AND CONDITIONED WATER FAUCET ASSEMBLY WITH PULL OUT SPRAYER HEAD

CROSS REFERENCE TO RELATED APPLICATIONS

This application is a U.S. National Phase Application under 35 U.S.C. 371 of International Application No. PCT/US2018/040274 filed on Jun. 29, 2018, which claims the benefit of priority from U.S. Provisional Application No. 62/529,509 filed Jul. 7, 2017. The entire disclosures of all of the above applications are incorporated herein by reference.

FIELD

The present disclosure relates to an integrated mixed tap water and conditioned water faucet assembly with a pull-out sprayer head.

BACKGROUND

This section provides background information related to the present disclosure, which is not necessarily prior art.

Integrated tap water and conditioned water dispenser faucets are sometimes used for sinks, typically kitchen sinks, and control the dispensing of mixed tap water and one or more types of conditioned water, depending on the configuration of the faucet. The types of conditioned water can include, by way of example and not of limitation, hot water from a hot water dispenser (such as near boiling hot water from a near boiling hot water dispenser), chilled water, filtered cool water, carbonated water, and the like. The faucet has a spout assembly having a spout, a tap water mixing valve and conditioned water valve which are typically disposed in respective valve bodies of a body of the faucet. The tap water mixing valve is fluidly coupled to sources of hot and cold tap water and is adjustable via a handle to dispense hot and cold tap water and mix the hot and cold tap water being dispensed in varying amounts depending on the position of the tap water mixing valve. The faucet also has a conditioned water valve that is adjustable via a handle to dispense the conditioned water. The conditioned water valve is fluidly coupled to a source of conditioned water or to a source of cool water, which may be filtered water, in the case of a hot water dispenser. The spout has a mixed tap water line and a conditioned water line therein that fluidly couple outlets of the tap water mixing valve and an outlet of the conditioned water valve to a dispensing end assembly of the spout.

Where the conditioned water is near boiling water provided by a non-pressurized hot water dispenser, an inlet of the conditioned water valve is coupled to the source of cool water, such as filtered water, and an outlet of the conditioned water valve is also coupled to an inlet of the conditioned water line through the hot water dispenser. More specifically, the outlet of the conditioned water valve is fluidly coupled to a water inlet of the hot water dispenser and a hot water outlet of the hot water dispenser is fluidly coupled to an inlet of the conditioned water line. When the conditioned water valve is opened, water flows through it from the source of cool water into the inlet of the hot water dispenser, which then forces hot water to flow out of the hot water dispenser into the conditioned water line. The spout may also have a vent line that fluidly couples a vent of the hot water dispenser to the dispensing end assembly of the spout assembly. In the case where the near boiling water hot water dispenser is a pressurized hot water dispenser, a water outlet of the hot water dispenser is fluidly coupled to the inlet of the conditioned water valve and the outlet of the conditioned water valve is fluidly coupled to the inlet of the conditioned water line without going through the hot water dispenser.

EP 2 975 185 A1 shows an integrated tap water and hot water dispenser faucet having an L-shaped spout having a horizontal portion with a pull-out sprayer head at the end through which mixed water is dispensable and which can be pulled out horizontally from the end of the spout. A hot water outlet is disposed in the horizontal portion of the spout spaced inwardly from the sprayer head. Another type of integrated tap water and hot water dispenser faucet has a J-shaped spout. Currently available integrated tap water and conditioned water dispenser faucets having a J-shaped spout do not include a pull-out sprayer head. Space issues within the valve body and J-shaped spout present a design concern in providing a pull-out sprayer head in integrated tap water and conditioned water dispenser faucets having a J-shaped spout. Another design concern is the requirement that conditioned water cannot exit through the pull-out sprayer head.

SUMMARY

This section provides a general summary of the disclosure, and is not a comprehensive disclosure of its full scope or all of its features.

In accordance with an aspect of the present disclosure, an integrated tap water and conditioned water faucet assembly with a pull-out sprayer head has a faucet body, a hot and cold tap water mixing valve assembly and a spout. The spout has an upwardly extending portion that extends upwardly from the faucet body, a downwardly extending dispensing portion and a bight portion that bridges between the upwardly extending portion and the downwardly extending dispensing portion. The downwardly extending dispensing portion of the spout has a lower end at which a conditioned water housing and the sprayer head are disposed. The sprayer head has a housing that is removably held to the conditioned water housing when the sprayer head is in a retracted position. The conditioned water housing and the sprayer head when in the retracted position extend downwardly from the downwardly extending dispensing portion of the spout. The conditioned water housing has a conditioned water outlet at a lower end of the conditioned water housing. The sprayer head has a mixed tap water inlet at an upper end. The sprayer head has a non-spray outlet and a spray outlet at a lower end of the sprayer head. The sprayer head further includes a sprayer mechanism that has a sprayer head mixed tap water valve that is user actuable between a spray position and a non-spray position. When the sprayer head mixed tap water valve is in the spray position, it fluidly couples the mixed tap water inlet of the sprayer head to the spray outlet so that mixed tap water will flow through the sprayer head mixed tap water valve and then out of the sprayer head through the spray outlet and fluidly decouples the mixed tap water inlet and non-spray outlet. When the sprayer head mixed tap water valve is in the non-spray position, it fluidly couples the mixed tap water inlet of the sprayer head to the non-spray outlet so that mixed tap water will flow through the sprayer head mixed tap water valve and then out of the non-spray outlet and fluidly decouples the mixed tap water inlet of sprayer head from the spray outlet. The faucet assembly further includes a sprayer hose extending through an interior of the spout and fluidly coupling the hot and cold water mixing valve assembly to the mixed tap water inlet of the sprayer head, an electrically actuated conditioned water valve assembly having an outlet fluidly couplable to an inlet of a conditioned water line, the conditioned water line extending through the interior of the spout and is fluidly coupled to the conditioned water outlet of the conditioned water housing. The electrically actuated conditioned water valve assembly includes at least one electrically actuated conditioned water valve.

In an aspect, the outlet of the conditioned water valve assembly is fluidly couplable to the inlet of the conditioned water line through a hot water tank of a hot water dispenser wherein the outlet of the conditioned water valve assembly is fluidly couplable to a water inlet of the hot water tank and the inlet of the conditioned water line is fluidly couplable to a hot water outlet of the hot water tank. The faucet assembly further includes a vent line extending through the interior of the spout and through the conditioned water housing to a vent outlet of the conditioned water housing. The vent line is fluidly couplable to a vent outlet of the hot water tank.

In an aspect, the hot and cold tap water mixing valve assembly is an electrically actuated mixing valve assembly having an electrically actuated hot and cold tap water mixing valve and the faucet assembly includes a user actuable electronic water control assembly electrically coupled to the hot and cold tap water electrically actuated mixing valve and to the electrically actuated conditioned water valve.

In an aspect, the electrically actuated hot and cold water mixing valve and the electrically actuated conditioned water valve are disposed in a valving box that is separate from the faucet body.

In an aspect, the electrically actuated conditioned water valve assembly includes a plurality of electrically actuated conditioned water valves disposed in the valving box wherein one of the electrically actuated conditioned water valve is an electrically actuated hot water valve. The electrically actuated hot water valve has an outlet fluidly couplable to the inlet of the conditioned water line.

In an aspect, the outlet of the electrically actuated hot water valve is fluidly couplable to the inlet of the conditioned water line through a hot water tank of a hot water dispenser wherein the outlet of the electrically actuated hot water valve is fluidly couplable to a water inlet of the hot water tank and the inlet of the conditioned water line is fluidly couplable to a hot water outlet of the hot water tank, the faucet assembly further including a vent line extending through the interior of the spout and through the conditioned water housing to a vent outlet of the conditioned water housing. The vent line is fluidly couplable to a vent outlet of the hot water tank.

In an aspect, the hot and cold tap water mixing valve assembly includes a mechanically actuated hot and cold tap water mixing valve assembly having a mixing valve cartridge disposed in a mixing valve housing of the faucet body. The electrically actuated conditioned water valve is disposed in a valving box that is separate from the faucet body. The faucet assembly also includes a user actuable conditioned water touch button assembly electrically coupled to the electrically actuated conditioned water valve.

In an aspect, the electrically actuated conditioned water valve assembly includes a plurality of electrically actuated conditioned water valves disposed in the valving box wherein one of the electrically actuated conditioned water valves is an electrically actuated hot water valve. The electrically actuated hot water valve has an outlet fluidly couplable to the inlet of the conditioned water line. In an aspect, the outlet of the electrically actuated hot water valve is fluidly couplable to the inlet of the conditioned water line through a hot water tank of a hot water dispenser wherein the outlet of the electrically actuated hot water valve is fluidly couplable to a water inlet of the hot water tank and the inlet of the conditioned water line is fluidly couplable to a hot water outlet of the hot water tank. The faucet assembly further includes a vent line extending through the interior of the spout and through the conditioned water housing to a vent outlet of the conditioned water housing. The vent line is fluidly couplable to a vent outlet of the hot water tank.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

Figure 1:
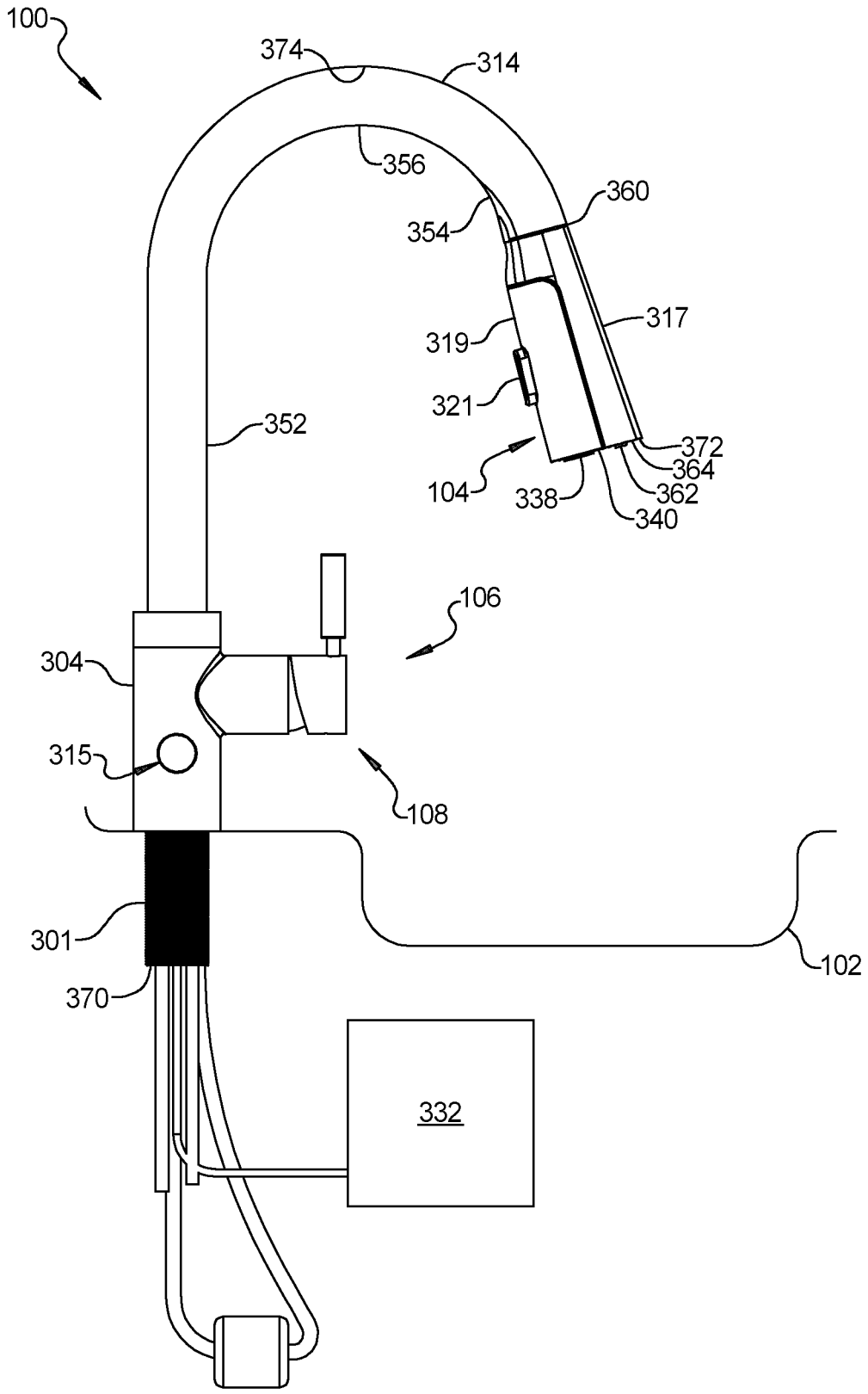
FIG. 1 is a perspective view of a mixed tap water and conditioned water faucet assembly having a J-shaped spout with a pull-out sprayer head and a mechanically actuated hot and cold tap water mixing valve assembly in accordance with an aspect of the present disclosure showing the sprayer head in a retracted position.
Figure 2:
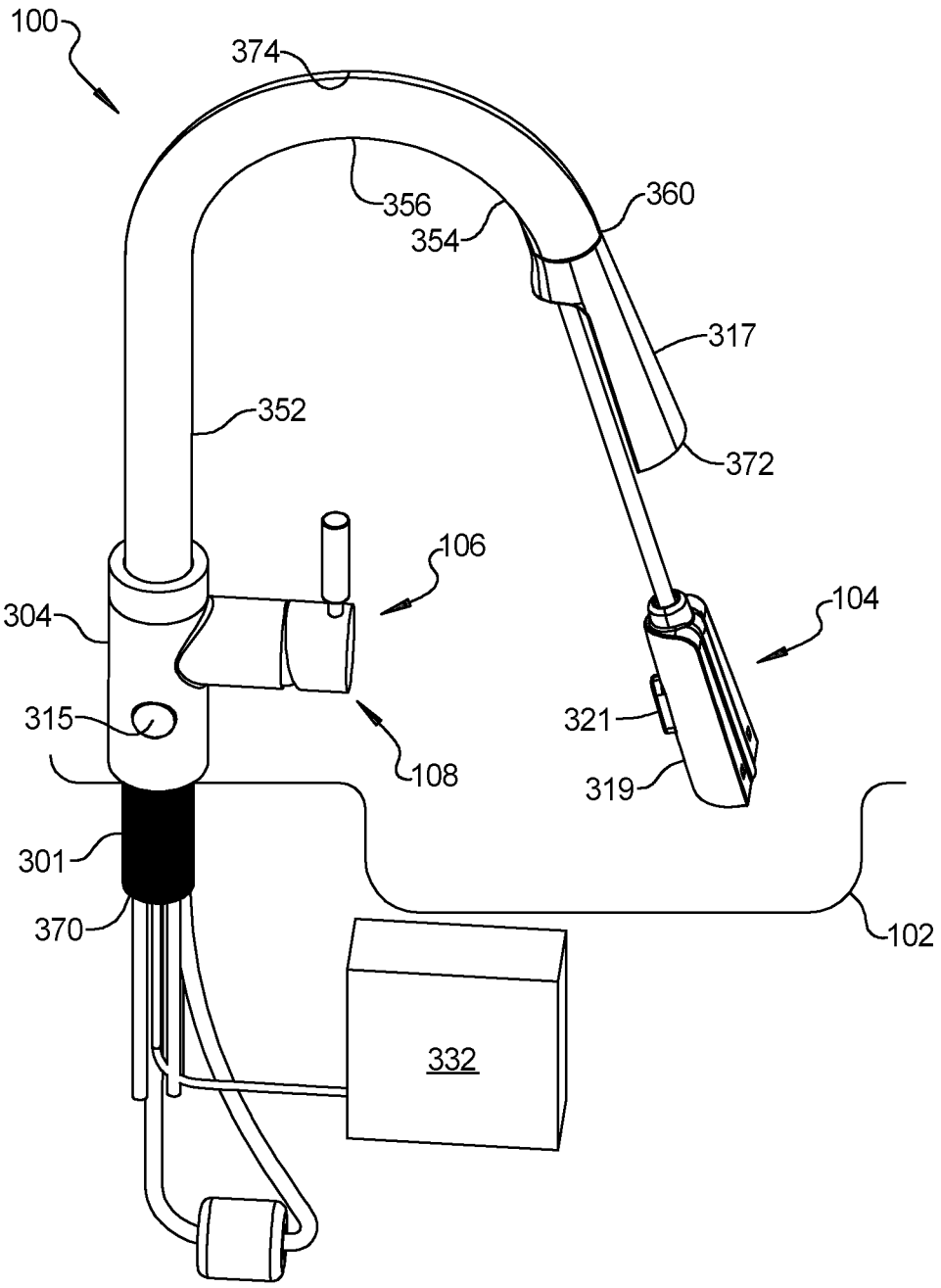
FIG. 2 is a perspective view of the faucet assembly of FIG. 1 showing the sprayer head in an extended position.
Figure 3:
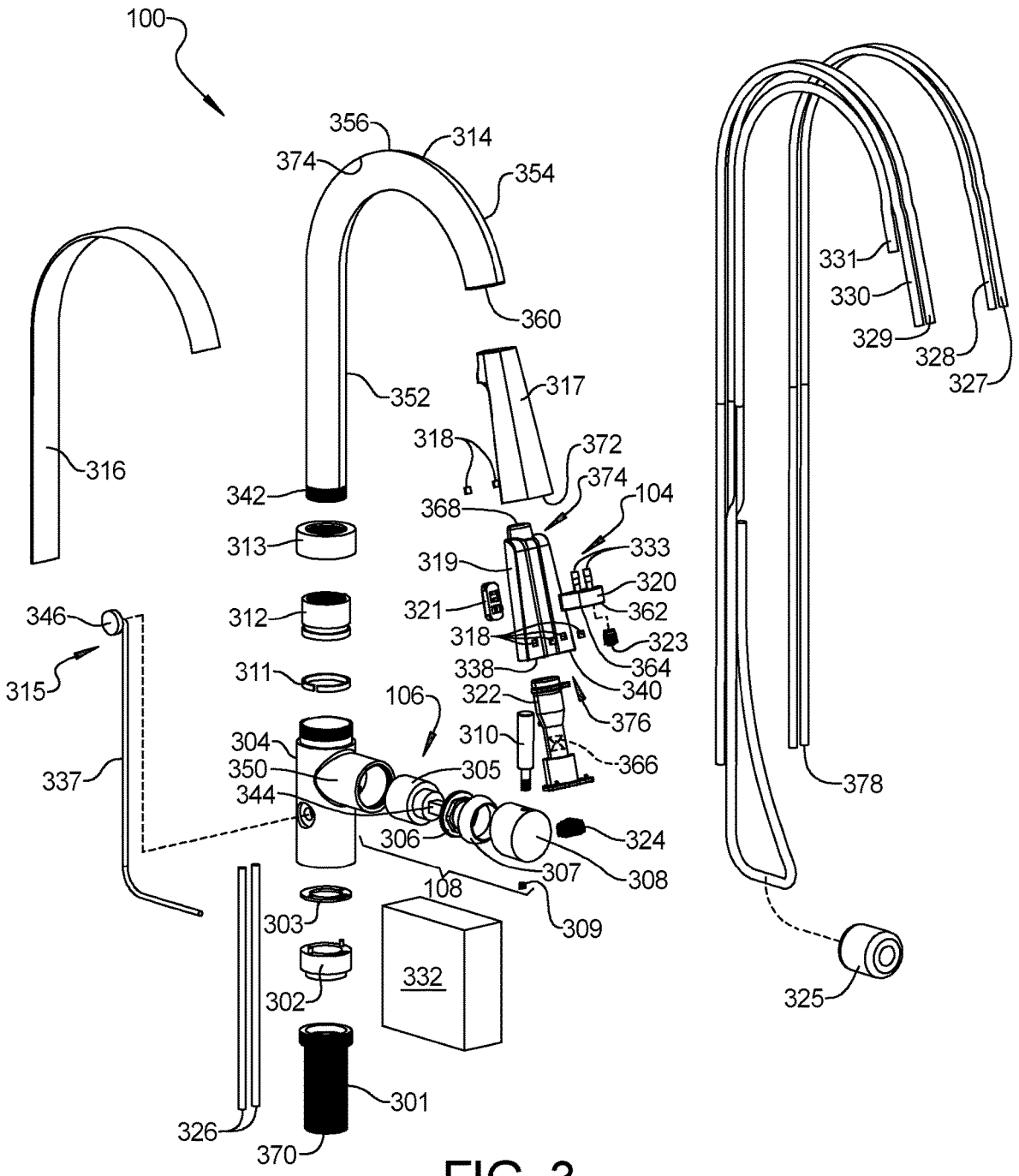
FIG. 3 is an exploded view of the faucet assembly of FIGS. 1 and 2.
Figure 4:
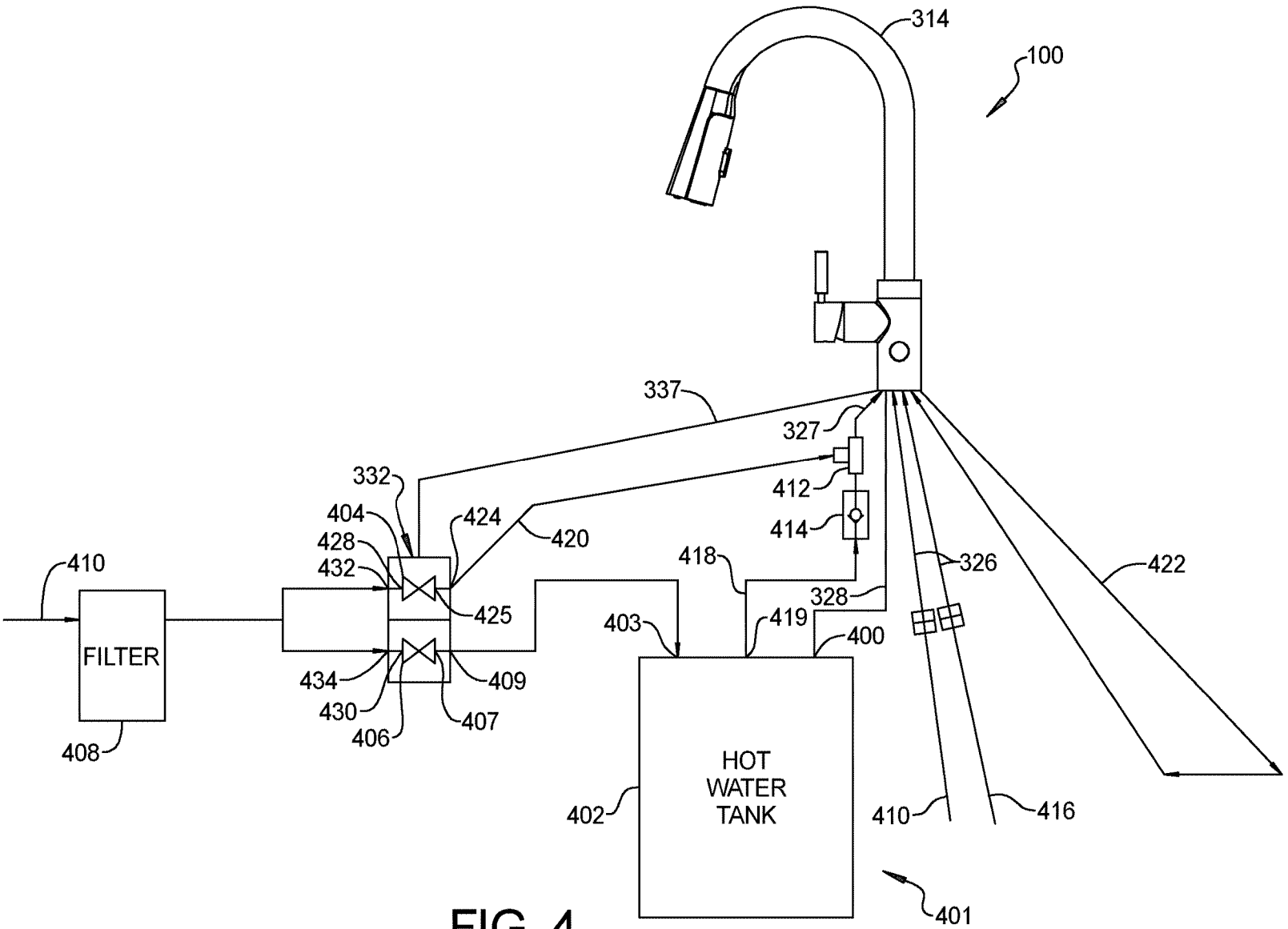
FIG. 4 is a simplified schematic showing the faucet assembly of FIGS. 1-3 and water supply and electrical control interconnections.

FIG. 1 shows an exterior perspective view of an integrated tap water and conditioned water faucet assembly 100 mounted on a sink 102 and referred to herein as faucet assembly 100. Faucet assembly 100 has a pull-out sprayer head 104 with sprayer head 104 shown in a retracted position in FIG. 1. FIG. 2 is an exterior perspective view of faucet assembly 100 showing sprayer head 104 in an extended position. FIG. 3 is an exploded view of faucet assembly 100. FIG. 4 is a simplified schematic showing faucet assembly 100 and water supply and electrical control interconnections as discussed in more detail below.

With reference to FIG. 3 in particular, faucet assembly 100 includes a threaded stem 301, adaptor 302, adaptor gasket 303, faucet body 304, a hot and cold tap water mixing valve assembly 106, spout wearing ring 311, spout adaptor 312, spout adaptor cap 313, spout 314, conditioned water touch button assembly 315, spout divider 316, conditioned water housing 317, sprayer magnets 318, sprayer head housing 319 of sprayer head 104, conditioned water adaptor 320, sprayer button 321 of sprayer head 104, sprayer mechanism 322 of sprayer head 104, conditioned water aerator 323, sprayer aerator 324 of sprayer head 104, sprayer hose weight 325, hot and cold tap water inlet lines 326, conditioned water line 327, vent line 328, conditioned water line sleeve 329, vent line sleeve 330, sprayer hose 331 and valving box 332. In the embodiment shown in FIGS. 1-4, hot and cold tap water mixing valve assembly 106 is a mechanically actuated mixing valve assembly 108 described in more detail below. Illustratively, hot and cold tap water inlet lines 326, conditioned water line 327 and vent line 328 are plastic tubes and sprayer hose 331 is a braided hose.

In the embodiment shown in FIGS. 1-4, spout 314 is illustratively J-shaped having an upwardly extending portion 352 that extends upwardly from faucet body 304, a downwardly extending dispensing portion 354 and a bight portion 356 that bridges between the upwardly extending portion 352 and the downwardly extending dispensing portion 354.

The conditioned water housing 317 is illustratively a hollow shell attached to or integrally formed with the spout 314 and extends downwardly from lower end 360 of dispensing portion 354 of spout 314. Sprayer head 104 when in the retracted position also extends downwardly from lower end 360 of dispensing portion 354. The conditioned water adaptor 320 is attached to the conditioned water housing 317 and has a conditioned water outlet 362 and a vent outlet 364. For example, conditioned water adaptor 320 is attached to the conditioned water housing 317 with small plastic clips (not shown) on the sides of conditioned water adaptor 320 that snap into place on the conditioned water housing 317. The conditioned water adaptor 320 illustratively has two barbed connections 333. One of these barbed connections 333 is inserted into the conditioned water line 327 to provide a fluid flow path from the conditioned water line 327 to a conditioned water outlet 362 to which conditioned water aerator 323 is attached. The second barbed connection 333 is inserted into the vent line 328. Vent line 328 provides a vent path through spout 314 that vents out of vent outlet 364. Conditioned water outlet 362 and vent outlet 364 are disposed at a lower end 372 of conditioned water housing 317. It should be understood that faucet assembly 100 has the vent path when faucet assembly 100 is for use with a non-pressurized hot water dispenser. In a variation where faucet assembly 100 is for use with a pressurized hot water dispenser, faucet assembly 100 need not have the vent path and thus need not have vent line 328. In this variation, a hot water outlet of the pressurized hot water dispenser is fluidly coupled to inlet 434 of valving box 332 and thus to inlet 430 (FIG. 4) of valve 406 and outlet 409 of valving box 332 and thus outlet 407 of valve 406 is fluidly coupled to an inlet 378 (FIGS. 3 & 6) of conditioned water line 327 without going through the pressurized hot water dispenser. In another variation where faucet assembly is not for use with a hot water dispenser, faucet assembly 100 need not have the vent path and thus does not have vent line 328.

The sprayer head housing 319 houses the sprayer mechanism 322. The sprayer mechanism 322 is illustratively attached to the sprayer head housing 319 with plastic clips (not shown). These plastic clips are illustratively on the side of the sprayer mechanism 322 and are inserted into slots (not shown) in the sprayer head housing 319. The sprayer hose 331 runs through an opening (not shown) in the top of the sprayer head housing 319 and is fluidly attached to the sprayer mechanism 322. The sprayer head 104 has a non-spray outlet 338 and a spray outlet at a lower end 376 of the sprayer head 104. The sprayer mechanism 322 provides a selectable fluid flow path to either a non-spray outlet 338 of sprayer head 104 or to a spray outlet 340 of sprayer head 104 that is selectable by positioning of sprayer button 321 in either a non-spray position or a spray position. In this regard, sprayer mechanism 322 provides a sprayer head mixed tap water valve 366. Sprayer aerator 324 is affixed to non-spray outlet 338.

Sprayer button 321 is pushed by a user to the spray position to select the fluid path to the spray outlet 340 and to the non-spray position to select the fluid path to the non-spray outlet 338. When the fluid path to the non-spray outlet 338 is selected, sprayer head mixed tap water valve 366 is in the non-spray position, and there is an open fluid flow path through the sprayer mechanism 322 from mixed tap water inlet 368 of sprayer head 104, to which sprayer hose 331 is fluidly coupled, to the non-spray outlet 338 and the fluid flow path through the sprayer mechanism 322 from the sprayer hose 331 to the spray outlet 340 is closed. That is, when the sprayer head mixed tap water valve 366 is in the non-spray position it fluidly couples mixed tap water inlet 368 of the sprayer head 104 to the non-spray outlet 338 and fluidly decouples the mixed tap water inlet 368 from the spray outlet 340 so that mixed tap water will flow through the sprayer head mixed tap water valve 366 and then out of the non-spray outlet 338. When the fluid path to the spray outlet 340 is selected, sprayer head mixed tap water valve 366 is in the spray position, and there is an open fluid flow path through the sprayer mechanism 322 from the mixed tap water inlet 368 of sprayer head 104 to the spray outlet 340 and the fluid flow path through the sprayer mechanism 322 from the mixed tap water inlet 368 to the non-spray outlet 338 is closed. That is, when the sprayer head mixed tap water valve 366 is in the spray position, it fluidly couples mixed tap water inlet 368 of the sprayer head 104 to the spray outlet 340 and fluidly decouples the mixed tap water inlet 368 from the non-spray outlet 338 so that mixed tap water will flow through the sprayer head mixed tap water valve 366 and then out of the spray outlet 340. When the fluid flow path to the non-spray outlet 338 is selected, water from the sprayer hose 331 flows out through the sprayer aerator 324 so a laminar aerated stream of water can be produced. When the fluid flow path to the spray outlet 340 is selected, water from the sprayer hose 331 flows out through the spray outlet 340 in multiple sprayed streams.

The sprayer head housing 319 removably engages conditioned water housing 317. For example, a side of sprayer head housing 319 and a side of conditioned water housing 317 may slidably engage each other. When the sprayer head housing 319 is pulled down from a retracted position where it is engaged with the conditioned water housing 317 to an extended position where it is extended from the conditioned water housing 317, the conditioned water housing 317 will remain in place to ensure conditioned water cannot be directed anywhere but into the sink 102 to which faucet body 304 of faucet assembly 100 is mounted that is below a conditioned water outlet 362 of the conditioned water housing 317.

Sprayer hose weight 325 is attached to sprayer hose 331 such as beneath a bottom 342 of spout 314 where spout 314 is attached to faucet body 304. When the sprayer head housing 319 is being retracted back from the extended position to the retracted position where it is engaged with the conditioned water housing 317, sprayer hose weight 325 helps pulls the sprayer hose 331 back through spout 314 to assist in retracting the sprayer head housing 319 back into the retracted position. When the sprayer head housing 319 is in the retracted position, sprayer head housing 319 is held in place against conditioned water housing 317 by two sets of sprayer magnets 318. Two of the sprayer magnets are affixed to the sprayer head housing 319 with the other two sprayer magnets affixed to the conditioned water housing 317. The sprayer magnets 318 affixed to the conditioned water housing 317 and the sprayer magnets 318 affixed to the sprayer head housing 319 are oriented so that the respective poles on the two sets of sprayer magnets 318 attract and keep the sprayer head housing 319 in place in the retracted position.

The conditioned water line 327, the vent line 328, and the sprayer hose 331 are disposed in and extend through the interior 374 of the spout 314. Since the sprayer hose 331 moves when the sprayer head housing 319 is moved from the retracted position to the extended position, this presents a concern that the conditioned water line 327 and/or the vent line 328 could be damaged by contact and rubbing by sprayer hose 331. Spout divider 316 is disposed in spout 314 to separate sprayer hose 331 from conditioned water line 327 and vent line 328 to prevent sprayer hose 331 from contacting conditioned water line 327 and/or vent line 328 when sprayer hose 331 moves. The spout divider 316 could be a separate part made out of a flexible sheet metal or plastic, or formed integrally with spout 314. In an aspect, conditioned water line sleeve 329 is placed around conditioned water line 327 to protect conditioned water line 327 and vent line sleeve 330 is placed around vent line 328 to protect vent line 328. Sleeves 329 and 330 can be in addition to, or an alternative to, spout divider 316.

The spout 314 is threaded into the spout adaptor 312. Spout 314 and spout adaptor 312 are held onto the faucet body 304 by the spout adaptor cap 313, which goes over the spout adaptor 312 and threads onto the faucet body 304. To prevent grinding, a spout wearing ring 311 is placed on the spout adaptor 312.

Mechanically actuated mixing valve assembly 108 has a mixing valve cartridge 305 received in a mixing valve housing 350 of the faucet body 304 and held in place by threaded valve locking ring 306. A handle transition ring 307 is disposed over the valve locking ring 306 to provide an aesthetically pleasing look by eliminating or minimizing a gap between the handle base 308 and the faucet body 304. The handle base 308 is received on a valve stem 344 of the mixing valve cartridge 305 and held in place by the handle set screw 309. Threaded handle lever 310 is threadably tightened in a threaded hole (not shown) in the handle base 308 to secure threaded handle lever 310 to the handle base 308. Mechanically actuated mixing valve assembly 108 is actuated by a user moving handle lever 310.

Conditioned water touch button assembly 315 includes an electronic button 346 electrically coupled to wiring 337. Conditioned water touch button assembly 315 is attached to the faucet body 304 with wiring 337 routed below faucet body 104. The wiring 337 is electrically coupled to valving box 332. In the embodiment shown in FIG. 4 and with particular reference to FIG. 4, faucet assembly 100 is a four-in/one-out (4N1) faucet assembly (that has four water sources and provides one type of water output at a time) and valving box 332 has a plurality of electrically actuated conditioned water valves 404, 406 that control flow of water from two of the inlets with hot and cold tap water mixing valve assembly 106 controlling the flow of water from the other two water inlets. Electrically actuated conditioned water valves 404, 406 may for example be solenoid valves, but could be other types of electrically actuated valves such as electrically actuated ball valves. In the embodiment shown in FIG. 4, electrically actuated conditioned water valve 406 is an electrically actuated hot water valve.

Valves 404, 406 have respective inlets 428, 430 that are fluidly couplable, via inlets 432, 434 of valving box 332, to a source or sources, depending on the configuration, of conditioned water. Valves 404, 406 are respectively opened and closed under control of conditioned water touch button assembly 315 to provide the selected conditioned water to conditioned water line 327.

The following discussion is with reference to the embodiment shown in FIG. 4 in which the types of conditioned water are filtered water, such as filtered water from water filter 408, and hot water from hot water dispenser 401. In the embodiment shown in FIG. 4, the conditioned water is either filtered cool water from water filter 408 or hot water from hot water tank 402 of a hot water dispenser 401. Water filter 408 is fluidly coupled to a cold tap water supply line 410 which is fluidly coupled to a source (not shown) of cold tap water. In this regard, when valve 404 is opened, cool filtered water flows from water filter 408 through valve 404 to conditioned water line 327 via t-fitting 412. When valve 406 is opened, water flows from water filter 408 through valve 406 into hot water tank 402 which forces hot water from hot water tank 402 to flow to conditioned water line 327 via check valve 414 and t-fitting 412. Valve 406 has an outlet 407 fluidly coupled to an outlet 409 of valving box 332, with outlet 409 fluidly couplable to a water inlet 403 of hot water tank 402.

Hot and cold tap water inlet lines 326 are fluidly couplable respectively to respective hot water supply line 416 and cold tap water supply line 410. A mixed tap water line fluidly couples an outlet of hot and cold tap water mixing valve assembly 106 to sprayer hose 331. Different combinations of button touching on the conditioned water touch button assembly 315 selects the source of water that flows through valving box 332. If faucet assembly 100 is a three-in/one out (3N1) faucet assembly, valving box 332 would then only have one of conditioned water valves 404, 406.

Adaptor 302 is placed with gasket 303 on the bottom of the faucet body 304. Hot and cold tap water inlet lines 326 that fluidly couple the mechanically actuated mixing valve assembly 108 to hot and cold tap water supply lines 416, 410 run through the adaptor 302 and threaded stem 301 and extend out a bottom 370 of threaded stem 301 beneath sink 102. The adaptor 302 is held in place by threading the threaded stem 301 into the faucet body 304, which also mounts faucet body 304 to sink 102. That is, threaded stem 301 extends down through a mounting hole (not shown) in sink 102 and a nut (not shown) is tightened on threaded stem 301 to secure threaded stem 301 and faucet body 304 to sink 102.

In the embodiment shown in FIG. 4, there are four water supply lines for faucet assembly 100. Two of them are the hot and cold tap water inlet lines 326 which are fluidly coupled to hot and cold tap water supply lines 416, 410 beneath sink 102. Hot and cold tap water inlet lines 326 provide hot and cold tap water to hot and cold tap water mixing valve assembly 106, which is mechanically actuated mixing valve assembly 108 in the embodiment of FIGS. 1-4. When the mechanically actuated mixing valve assembly 108 is opened, such as by a user moving handle lever 310, mixed hot and cold tap water flows out of mixing valve cartridge 305 into sprayer hose 331 and flows through sprayer hose 331 to the sprayer mechanism 322. When the sprayer button 321 is in the standard aerated water outlet position (non-spray position) discussed above, aerated mixed hot and cold tap water flows out of the sprayer aerator 324. When the sprayer button 321 is in the sprayer outlet position (spray position) discussed above, multiple sprayed streams of hot and cold mixed tap water flows out of the sprayer aerator 324. Line 422 fluidly couples an outlet (not shown) of mechanically actuated mixing valve assembly 108 to sprayer hose 331.

A third water supply line 418 runs from a hot water outlet 419 of hot water tank 402 to conditioned water line 327 via check valve 414 and t-fitting 412. When the conditioned water touch button assembly 315 is activated to select hot water from hot water tank 402, the valve 406 in the valving box 332 opens and filtered water flows through valve 406 into water inlet 403 of hot water tank 402 forcing hot water to flow out of hot water tank 402 to conditioned water line 327 as discussed above. This hot water then flows through conditioned water line 327 and out of the conditioned water aerator 323.

A fourth water supply line 420 runs from an outlet 424 of valving box 332 to which an outlet 425 of valve 404 is fluidly coupled. When the conditioned water touch button assembly 315 is activated to select cool, filtered water, valve 404 is opened and filtered cool water from water filter 408 flows through valve 404 and supply line 420 into the conditioned water line 327 via t-fitting 412 and then runs through conditioned water line 327 and exits out of conditioned water aerator 323.

The vent line 328 is fluidly couplable to vent outlet 400 of the hot water tank 402 and vents expanded steam and water from hot water tank 402 out through vent outlet 364 of conditioned water adaptor 320.

Figure 5:
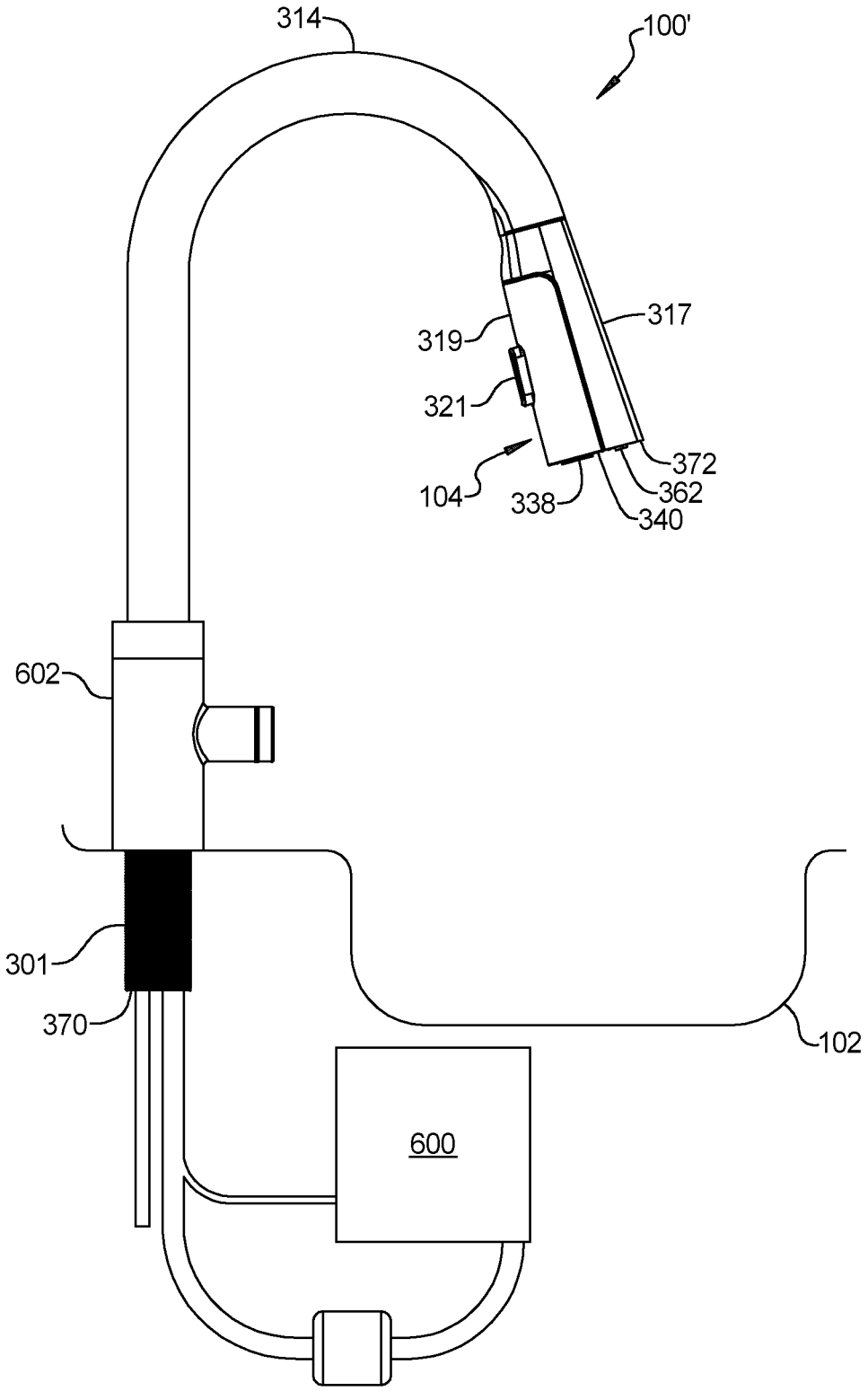
FIG. 5 is a perspective view of a mixed tap water and conditioned water faucet assembly having an electrically actuated hot and cold tap water mixing valve assembly that is a variation of the faucet assembly shown in FIGS. 1-4.
Figure 6:
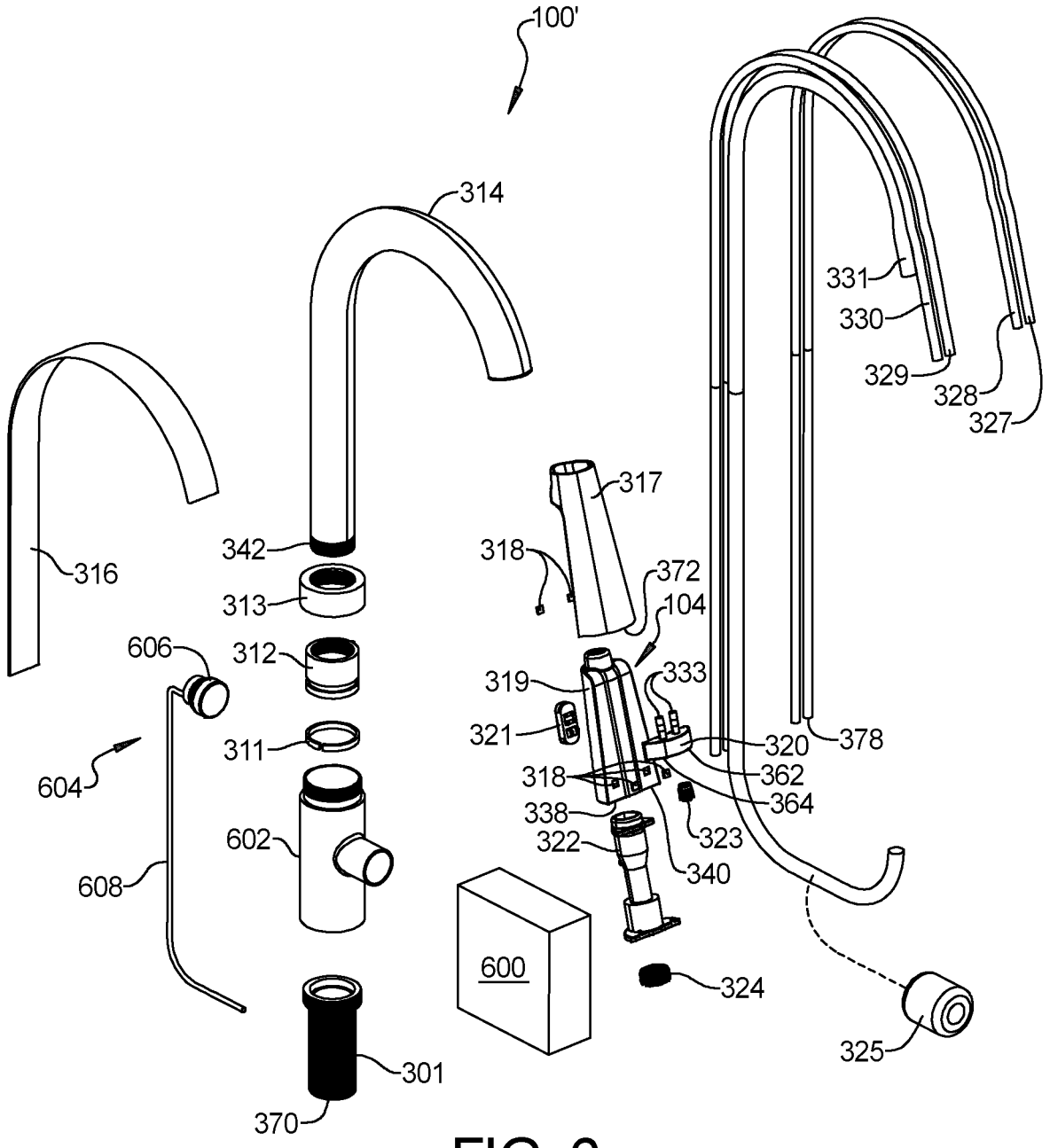
FIG. 6 is an exploded view of the faucet assembly of FIG. 5.
Figure 7:
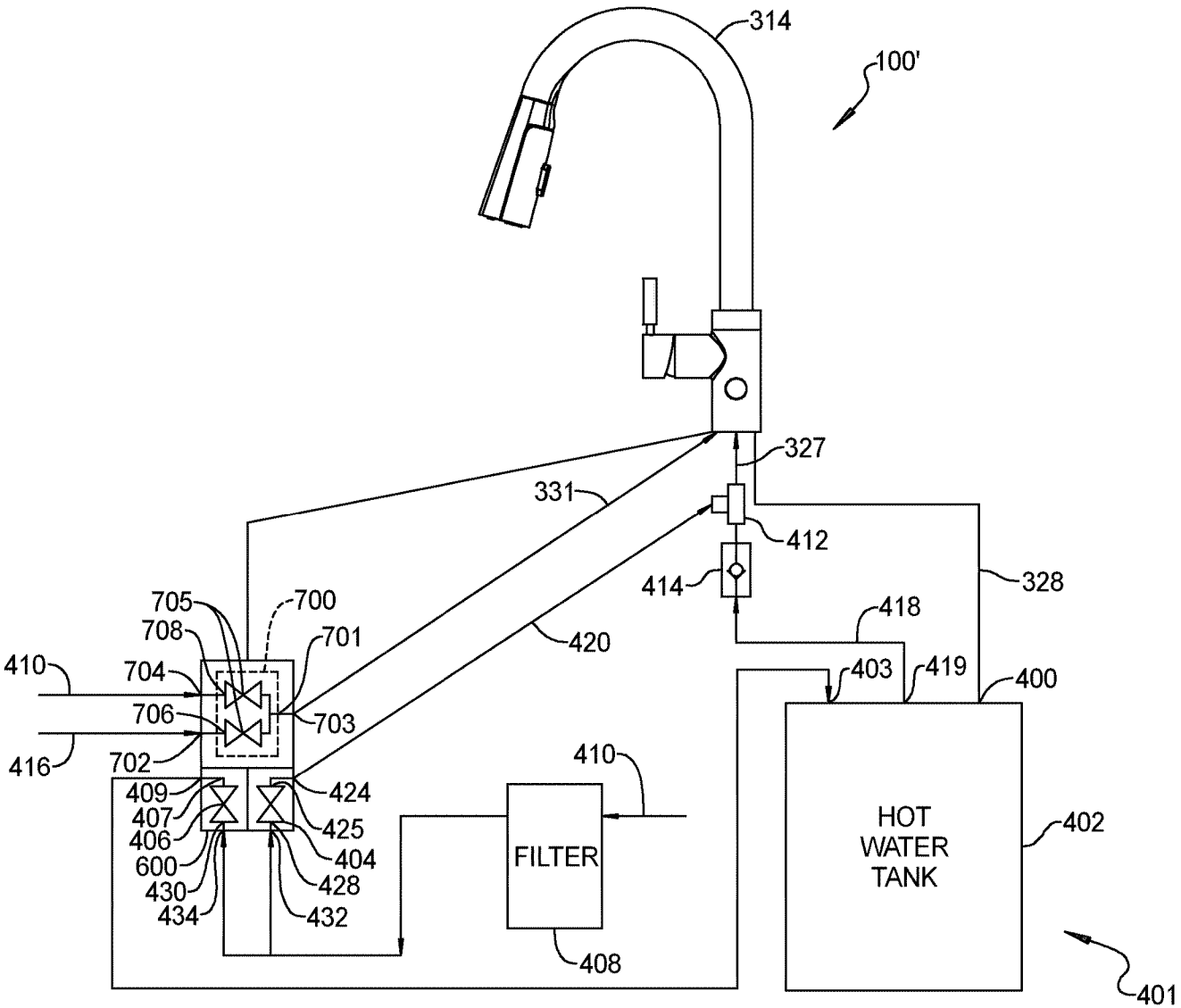
FIG. 7 is a simplified schematic showing the faucet assembly of FIGS. 5 and 6 and water supply and electrical control interconnections.

FIGS. 5-7 show a faucet assembly 100' that is a variation of faucet assembly 100. Many of the components of faucet assembly 100' are the same as the components of faucet assembly 100 described with reference to FIGS. 1-4, and the following discussion will focus on the differences. In faucet assembly 100', the hot and cold tap water mixing valve assembly 106 is an electrically actuated mixing valve assembly 700 (FIG. 7) illustratively included in valving box 600 instead of mechanically actuated mixing valve assembly 108 and for example includes an electrically actuated variable flow valve for hot tap water and cold tap water, such as electrically actuated ball valves. It should be understood that the electrically actuated variable flow valve could be other types of electrically actuated variable flow valves. In this regard, faucet assembly 100' includes faucet body 602 and valving box 600 rather than faucet body 304 and valving box 332, which differ in that faucet body 602 does not include mixing valve housing 350 (and does not include mechanically actuated mixing valve assembly 108) and valving box 600 includes electrically actuated mixing valve assembly 700 for mixing hot and cold tap water which valving box 332 does not. Electrically actuated mixing valve assembly includes at least one electrically actuated valve 705 with the embodiment shown in FIG. 7 having two electrically actuated valves 705, one for hot water and the other for cold water. Faucet assembly 100' also includes electronic water control assembly 604 instead of conditioned water touch button assembly 315.

The electronic water control assembly 604 is used to control the water temperature and flow rate of mixed hot and cold tap water through faucet assembly 100.' Electronic water control assembly 604 is also used to select flow of cool filtered water and hot water from hot water tank 402 through faucet assembly 100' (depending on whether faucet assembly 100' is a 4N1 or 3N1 faucet assembly, as discussed above). The electronic water control assembly 604 includes electronic touch button/dial 606 and wiring 608. Wiring runs through the faucet body 602 to the valving box 600. Electronic water control assembly 604 controls electrically actuated valves 705, 404, 406 in valving box 600. Different series of touches of electronic touch button/dial 606 selects the type of water, such as filtered cool water, filtered hot water, and mixed hot and cold tap water. Turning electronic touch button/dial 606 provides for adjustment of the temperature of the hot and cold tap water and also for adjustment of the flow rate of the hot and cold mixed tap water.

Hot and cold tap water supply lines 416, 410 are fluidly couplable to respective hot and cold water inlets 702, 704 of valving box 600. Hot and cold water inlets 702, 704 are fluidly coupled to respective hot and cold water inlets 706, 708 of electrically actuated mixing valve assembly 700. When the electronic water control assembly 604 is activated to select mixed tap water, mixed hot and cold tap water that is mixed by electrically actuated mixing valve assembly 700 in valving box 600 under control of electronic water control assembly 604 will flow out of outlet 701 of electrically actuated mixing valve assembly 700 and out of outlet 703 of valving box 600 into the sprayer hose 331 and through sprayer hose 331 to the sprayer mechanism 322. When the electronic water control assembly 604 is activated to select filtered, cool water, valve 404 in valving box 600 is opened. This allows filtered, cool water to run into the conditioned water line 327 as discussed above and this cool, filtered water will flow through and out the conditioned water aerator 323. When the electronic water control assembly 604 is activated to select hot water from hot water tank 402, valve 406 in the valving box 600 under control of electronic water control assembly 604 is opened. When valve 406 is opened, this allows hot water from hot water tank 402 to flow into the conditioned water line 327 as discussed above.

Figure 8:
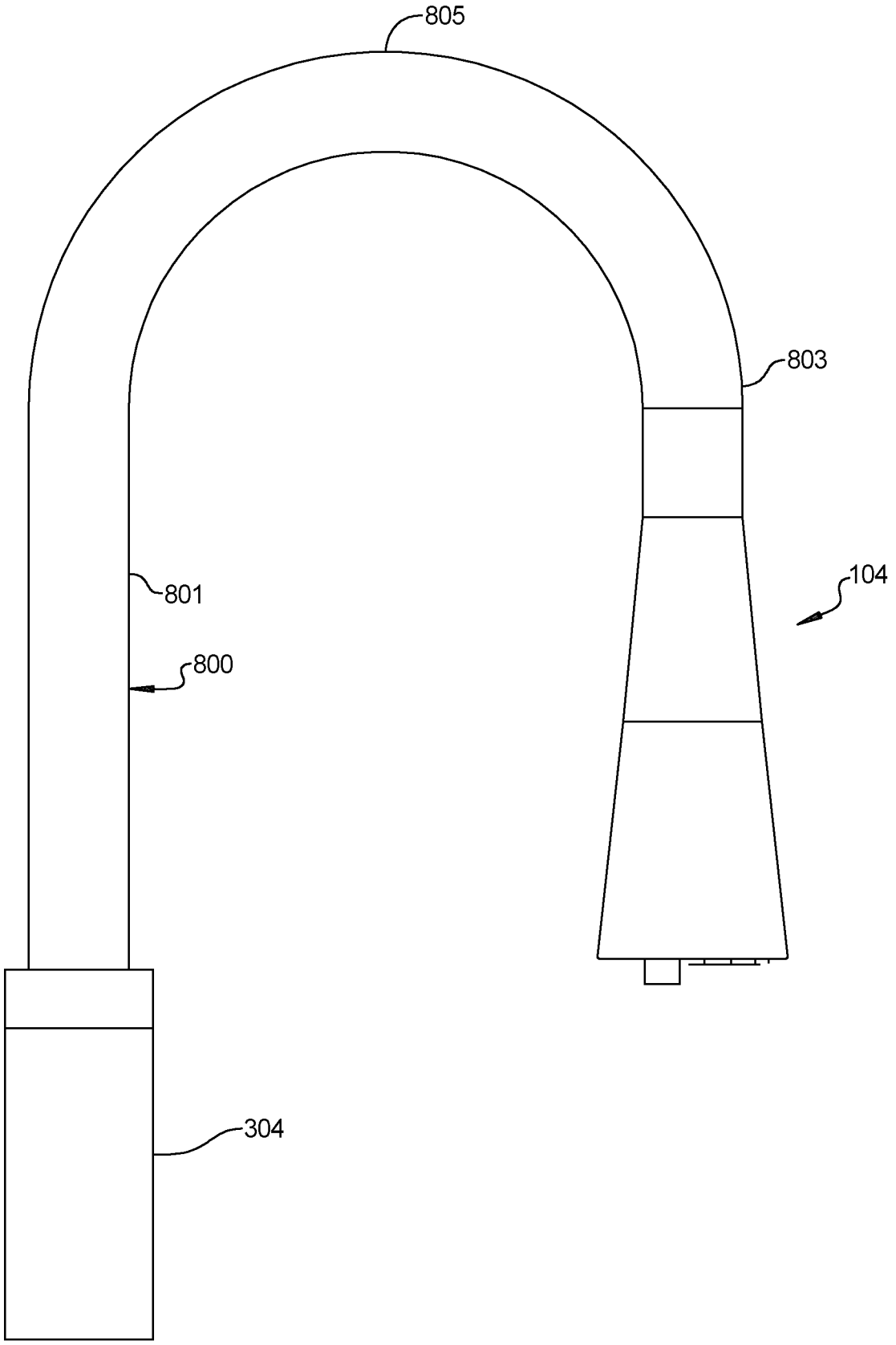
FIG. 8 is a perspective view showing a variation of the spout of the faucet assemblies of FIGS. 1-7 in which the spout is a U-shaped spout.
Figure 9:
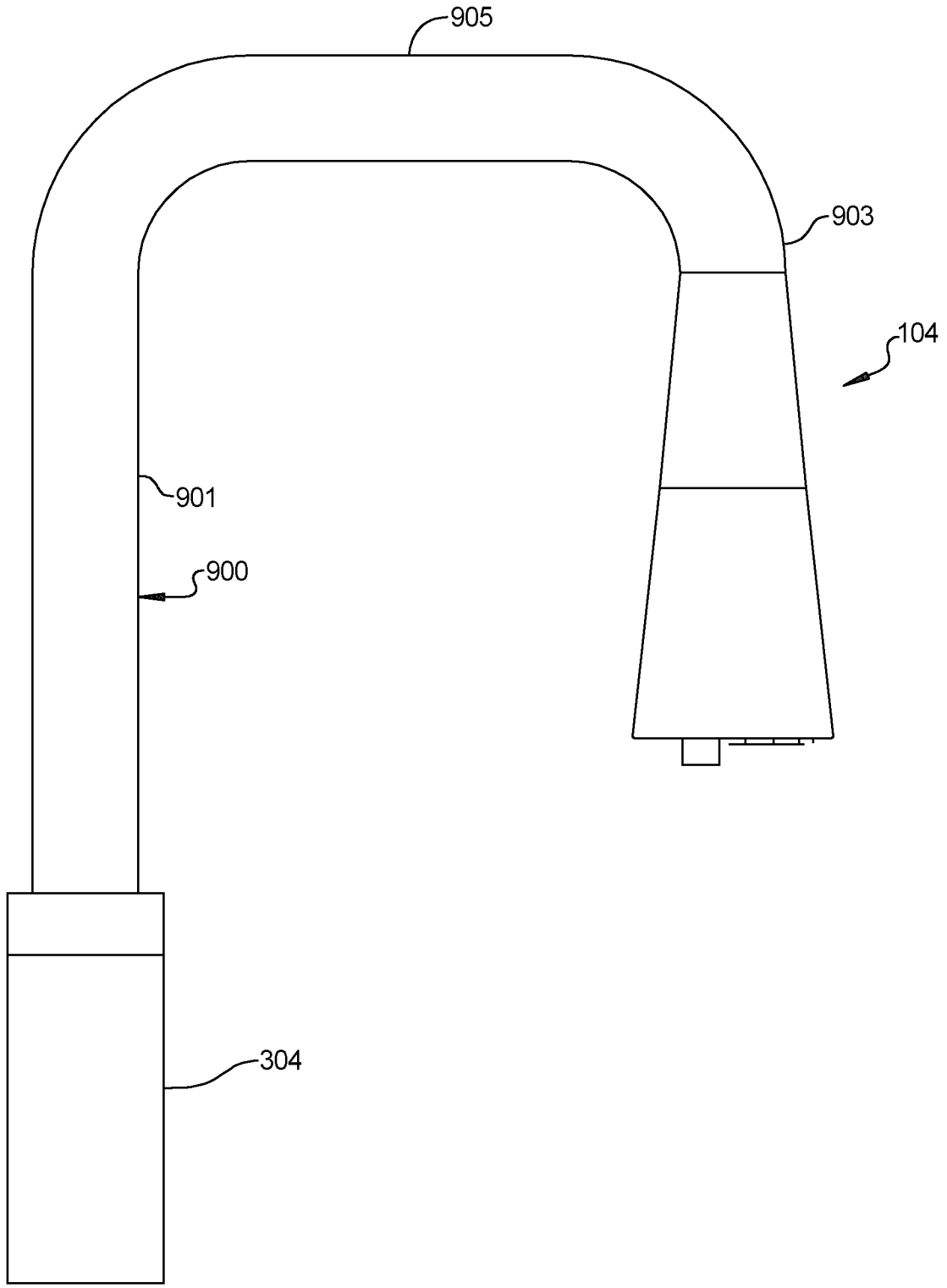
FIG. 9 is a perspective view showing a variation of the U-shaped spout shown in FIG. 8 in which the U-shaped spout has a straight bight.

FIGS. 8 and 9 show variations for the spout. In FIG. 8, the spout is a U-shaped spout 800 having upwardly extending portion 801, downwardly extending portion 803 and bight portion 805. In FIG. 9, the spout is a U-shaped spout 900 having upwardly extending portion 901, downwardly extending dispensing portion 903 and bight portion 905. In contrast to bight portion 805 of FIG. 8 that is curved, bight portion 905 is straight. It should be understood that the spout can have shapes other than a "J" or "U," such as a "C," as long as the spout has an upwardly extending portion and a downwardly extending dispensing portion wherein the conditioned water outlet opens downwardly and the outlet(s) in the sprayer head opens downwardly when the sprayer head is in the retracted position.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An integrated mixed tap water and conditioned water faucet assembly with a pull-out sprayer head, comprising:

a faucet body;

a hot and cold tap water mixing valve assembly;

a spout having an upwardly extending portion that extends upwardly from the faucet body, a downwardly extending dispensing portion and a bight portion that bridges between the upwardly extending portion and the downwardly extending dispensing portion;

the sprayer head movable between a retracted position and an extended position relative to the spout;

a conditioned water housing separate from the spout and fixed to a lower end of the downwardly extending dispensing portion of the spout and positioned between the spout and the sprayer head, the conditioned water housing and the sprayer head extending downwardly from the downwardly extending dispensing portion of the spout when in the retracted position, the sprayer head being movable relative to both the conditioned water housing and the spout when the sprayer head is pulled down to the extended position;

the sprayer head having a housing including a proximal end that is engaged with the conditioned water housing when the sprayer head is in a retracted position and disengaged from the conditioned water housing when the sprayer head is in the extended position;

the conditioned water housing comprising an adapter at a lower end of the conditioned water housing having a conditioned water outlet and a vent outlet;

the sprayer head having a mixed tap water inlet at an upper end, a non-spray outlet and a spray outlet at a lower end of the sprayer head;

the sprayer head further including a sprayer mechanism that has a sprayer head mixed tap water valve that is user actuable between a spray position and a non-spray position, wherein when the sprayer head mixed tap water valve is in the spray position it fluidly couples the mixed tap water inlet of the sprayer head to the spray outlet so that mixed tap water will flow through the sprayer head mixed tap water valve and then out of the sprayer head through the spray outlet and fluidly decouples the mixed tap water inlet and non-spray outlet, and wherein when the sprayer head mixed tap water valve is in its non-spray position it fluidly couples the mixed tap water inlet of the sprayer head to the non-spray outlet so that mixed tap water will flow through the sprayer head mixed tap water valve and then out of the non-spray outlet and fluidly decouples the mixed tap water inlet of the sprayer head from the spray outlet;

a sprayer hose extending through an interior of the spout and fluidly coupling the hot and cold tap water mixing valve assembly to the mixed tap water inlet of the sprayer head;

an electrically actuated conditioned water valve assembly having at least one electrically actuated conditioned water valve and an outlet fluidly couplable to an inlet of a conditioned water line;

the conditioned water line extending through the interior of the spout and that is fluidly coupled to the conditioned water outlet of the adapter of the conditioned water housing; and a vent line extending through the interior of the spout and through the conditioned water housing and fluidly coupled to the vent outlet of the adapter of the conditioned water housing such that the vent outlet is adjacent to at least one of the non-spray outlet and spray outlet when the sprayer head is in the retracted position, the vent line fluidly couplable to a vent outlet of a hot water tank of a hot water dispenser.

2. The faucet assembly of claim 1 wherein the outlet of the conditioned water valve is fluidly couplable to the inlet of the conditioned water line through the hot water tank of the hot water dispenser wherein the outlet of the conditioned water valve is fluidly couplable to a water inlet of the hot water tank and the inlet of the conditioned water line is fluidly couplable to a hot water outlet of the hot water tank.

3. The faucet assembly of claim 1 wherein the hot and cold tap water mixing valve assembly is an electrically actuated mixing valve assembly having an electrically actuated hot and cold tap water mixing valve, the faucet assembly including a user actuable electronic water control assembly electrically coupled to the hot and cold tap water electrically actuated mixing valve assembly and to the electrically actuated conditioned water valve.

4. The faucet assembly of claim 3 wherein the electrically actuated hot and cold water mixing valve and the electrically actuated conditioned water valve are disposed in a valving box that is separate from the faucet body.

5. The faucet assembly of claim 4 wherein the electrically actuated conditioned water valve assembly includes a plurality of electrically actuated conditioned water valves with one of the electrically actuated conditioned water valves being an electrically actuated hot water valve disposed in the valving box, the electrically actuated hot water valve having an outlet fluidly couplable to the inlet of the conditioned water line.

6. The faucet assembly of claim 5 wherein the outlet of the electrically actuated hot water valve is fluidly couplable to the inlet of the conditioned water line through the hot water tank of the hot water dispenser wherein the outlet of the electrically actuated hot water valve is fluidly couplable to a water inlet of the hot water tank and the inlet of the conditioned water line is fluidly couplable to a hot water outlet of the hot water tank.

7. The faucet assembly of claim 1 wherein the hot and cold tap water mixing valve assembly includes a mechanically actuated hot and cold tap water mixing valve assembly having a mixing valve cartridge disposed in a mixing valve housing of the faucet body, the electrically actuated conditioned water valve disposed in a valving box that is separate from the faucet body, the faucet assembly including a user actuable conditioned water touch button assembly electrically coupled to the electrically actuated conditioned water valve.

8. The faucet assembly of claim 7 wherein the electrically actuated conditioned water valve assembly includes a plurality of electrically actuated conditioned water valves with one of the electrically actuated conditioned water valves being an electrically actuated hot water valve disposed in the valving box, the electrically actuated hot water valve having an outlet fluidly couplable to the inlet of the conditioned water line.

9. The faucet assembly of claim 8 wherein the outlet of the electrically actuated hot water valve is fluidly couplable to the inlet of the conditioned water line through the hot water tank of the hot water dispenser wherein the outlet of the electrically actuated hot water valve is fluidly couplable to a water inlet of the hot water tank and the inlet of the conditioned water line is fluidly couplable to a hot water outlet of the hot water tank.

10. An integrated mixed tap water and conditioned water faucet assembly with a pull-out sprayer head, comprising:

a faucet body;

a hot and cold tap water mixing valve assembly;

a spout having an upwardly extending portion that extends upwardly from the faucet body, a downwardly extending dispensing portion and a bight portion that bridges between the upwardly extending portion and the downwardly extending dispensing portion;

the downwardly extending dispensing portion of the spout having a lower end at which a conditioned water housing and the sprayer head are disposed, the sprayer head having a housing that is removably held to the conditioned water housing when the sprayer head is in a retracted position, the conditioned water housing and the sprayer head when in the retracted position extending downwardly from the downwardly extending dispensing portion of the spout;

the conditioned water housing having a conditioned water outlet at a lower end of the conditioned water housing;

the sprayer head having a mixed tap water inlet at an upper end, a non-spray outlet and a spray outlet at a lower end of the sprayer head;

the sprayer head further including a sprayer mechanism that has a sprayer head mixed tap water valve that is user actuable between a spray position and a non-spray position, wherein when the sprayer head mixed tap water valve is in the spray position it fluidly couples the mixed tap water inlet of the sprayer head to the spray outlet so that mixed tap water will flow through sprayer head mixed tap water valve and then out of the sprayer head through the spray outlet and fluidly decouples the mixed tap water inlet and non-spray outlet, and wherein when the sprayer head mixed tap water valve is in its non-spray position it fluidly couples the mixed tap water inlet of the sprayer head to the non-spray outlet so that mixed tap water will flow through the sprayer head mixed tap water valve and then out of the non-spray outlet and fluidly decouples the mixed tap water inlet of the sprayer head from the spray outlet;

a sprayer hose extending through an interior of the spout and fluidly coupling the hot and cold water mixing valve assembly to the mixed tap water inlet of the sprayer head;

an electrically actuated conditioned water valve assembly having at least one electrically actuated conditioned water valve and an outlet fluidly couplable to an inlet of a conditioned water line;

the conditioned water line extending through the interior of the spout and that is fluidly coupled to the conditioned water outlet of the conditioned water housing; and wherein the outlet of the conditioned water valve is fluidly couplable to the inlet of the conditioned water line through a hot water tank of a hot water dispenser wherein the outlet of the conditioned water valve is fluidly couplable to a water inlet of the hot water tank and the inlet of the conditioned water line is fluidly couplable to a hot water outlet of the hot water tank, the faucet assembly further including a vent line extending through the interior of the spout and through the conditioned water housing to a vent outlet of the conditioned water housing, the vent line fluidly couplable to a vent outlet of the hot water tank.

11. The faucet assembly of claim 10 wherein the hot and cold tap water mixing valve assembly is an electrically actuated mixing valve assembly having an electrically actuated hot and cold tap water mixing valve, the faucet assembly including a user actuable electronic water control assembly electrically coupled to the hot and cold tap water electrically actuated mixing valve assembly and to the electrically actuated conditioned water valve.

12. The faucet assembly of claim 11 wherein the electrically actuated hot and cold water mixing valve and the electrically actuated conditioned water valve are disposed in a valving box that is separate from the faucet body.

13. The faucet assembly of claim 12 wherein the electrically actuated conditioned water valve assembly includes a plurality of electrically actuated conditioned water valves with one of the electrically actuated conditioned water valves being an electrically actuated hot water valve disposed in the valving box, the electrically actuated hot water valve having an outlet fluidly couplable to the inlet of the conditioned water line.

14. The faucet assembly of claim 13 wherein the outlet of the electrically actuated hot water valve is fluidly couplable to the inlet of the conditioned water line through the hot water tank of the hot water dispenser wherein the outlet of the electrically actuated hot water valve is fluidly couplable to a water inlet of the hot water tank and the inlet of the conditioned water line is fluidly couplable to a hot water outlet of the hot water tank.

15. The faucet assembly of claim 10 wherein the hot and cold tap water mixing valve assembly includes a mechanically actuated hot and cold tap water mixing valve assembly having a mixing valve cartridge disposed in a mixing valve housing of the faucet body, the electrically actuated conditioned water valve disposed in a valving box that is separate from the faucet body, the faucet assembly including a user actuable conditioned water touch button assembly electrically coupled to the electrically actuated conditioned water valve.

16. The faucet assembly of claim 15 wherein the electrically actuated conditioned water valve assembly includes a plurality of electrically actuated conditioned water valves with one of the electrically actuated conditioned water valves being an electrically actuated hot water valve disposed in the valving box, the electrically actuated hot water valve having an outlet fluidly couplable to the inlet of the conditioned water line.

17. The faucet assembly of claim 16 wherein the outlet of the electrically actuated hot water valve is fluidly couplable to the inlet of the conditioned water line through the hot water tank of the hot water dispenser wherein the outlet of the electrically actuated hot water valve is fluidly couplable to a water inlet of the hot water tank and the inlet of the conditioned water line is fluidly couplable to a hot water outlet of the hot water tank.

* * * * *